US005511632A

United States Patent [19]

Ermis

[11] Patent Number: 5,511,632

[45] Date of Patent: Apr. 30, 1996

[54] LADDER WITH AUXILIARY SUPPORT

[76] Inventor: Jerry J. Ermis, 5710 Killarmet, Corpus Christi, Tex. 78411

[21] Appl. No.: 282,721

[22] Filed: Jul. 25, 1994

[51] Int. Cl.[6] ..... E06C 1/38

[52] U.S. Cl. ..... 182/172; 182/107

[58] Field of Search ..... 182/172, 107; 248/200.1

[56] References Cited

U.S. PATENT DOCUMENTS

| | | | |
|---|---|---|---|
| 468,987 | 2/1892 | Fowler . | |
| 1,890,423 | 12/1932 | Teagarder . | |
| 2,051,420 | 8/1936 | Renholdt | 248/200.1 |
| 2,997,127 | 8/1961 | Wojtowicz | 182/172 |
| 3,508,628 | 4/1970 | Conrad | 182/172 |
| 3,786,900 | 1/1974 | Olsen | 182/172 |
| 3,901,354 | 8/1975 | Grebausky | 182/172 |
| 5,379,861 | 1/1995 | Amacker | 182/187 |

FOREIGN PATENT DOCUMENTS

| | | | |
|---|---|---|---|
| 219262 | 7/1924 | United Kingdom | 248/200.1 |

*Primary Examiner*—Alvin C. Chin-Shue
*Attorney, Agent, or Firm*—G. Turner Moller

[57] ABSTRACT

A ladder of the pivoted or leaning type includes a support pivoted for movement between a stowed position parallel to the ladder frame and an arcuately extended support position. The support includes telescoping members biased toward an axially extended position away from an axially retracted position. A lug mechanism prevents retracting movement of the telescoping members when the support is being used to stabilize the ladder. The lug is mounted for axial movement to disable the mechanism and allow the telescoping members to retract into an axially stowed position. A J-slot is used to hold the telescoping members in the stowed position.

10 Claims, 2 Drawing Sheets

LADDER WITH AUXILIARY SUPPORT

This invention relates to a ladder with an auxiliary support lending added stability to the ladder.

BACKGROUND OF THE INVENTION

Ladders tend to be unstable for a variety of reasons which are inherent in their design and use. To be practical, ladders must be portable and thus lightweight. Most ladder induced injuries are caused by the ladder shifting relative to the underlying support surface, such as may occur when the ground surface is uneven or soft. Relatively few injuries occur from simple tipping of folding ladders because the area of the base is surprisingly large. Usually, tipping is caused by an irregularity in the underlying surface or some softness in the underlying surface as the user applies weight to the ladder. It is accordingly not surprising that auxiliary props or supports have been applied to ladders for the purpose of increasing stability.

A typical auxiliary support includes a strut pivoted to the ladder, typically near the top in a folding ladder or near the middle in a straight or leaning type ladder. The strut is pivoted for movement between a stowed position adjacent the ladder frame and an extended position defining an acute angle with the ladder. Often, the auxiliary support can be telescoped, i.e. extended or retracted in an axial direction, to contact the underlying ground surface and provide additional stability. It is to this type device that this invention most nearly relates. Typical auxiliary supports for ladders are found in U.S. Pat. Nos. 2,997,127 and 3,901,354. Other disclosures of interest are found in U.S. Pat. Nos. 468,987 and 1,890,423.

SUMMARY OF THE INVENTION

A ladder of this invention provides increased stability with minimum attention and effort by the user. A ladder, such as a folding ladder or a straight ladder of the type to be leaned against an immovable object, is modified by pivotally attaching an auxiliary support to the ladder frame. The support is of an extendable and retractable type having a spring for extending the support until it reaches an underlying ground surface and means locking the support against retracting movement. This allows the support to automatically keep in contact with the underlying ground surface during any rocking or wiggling movement of the ladder caused by the user and retain the ability to support a load. Means are provided for unlocking the support, untelescoping it to a retracted position and retaining it in the retracted position.

It is an object of this invention to provide a ladder having improved stability.

A further object of this invention is to provide a ladder having one or more pivoted supports having means biasing the support toward an extended position and means locking the support against movement toward a retracted position.

Another object of this invention is to provide a ladder of improved stability which is easy to use, requiring minimum effort by the user.

These and other objects of this invention will become more fully apparent as this description proceeds, reference being made to the accompanying drawings and appended claims.

DETAILED DESCRIPTION

Figure 1:
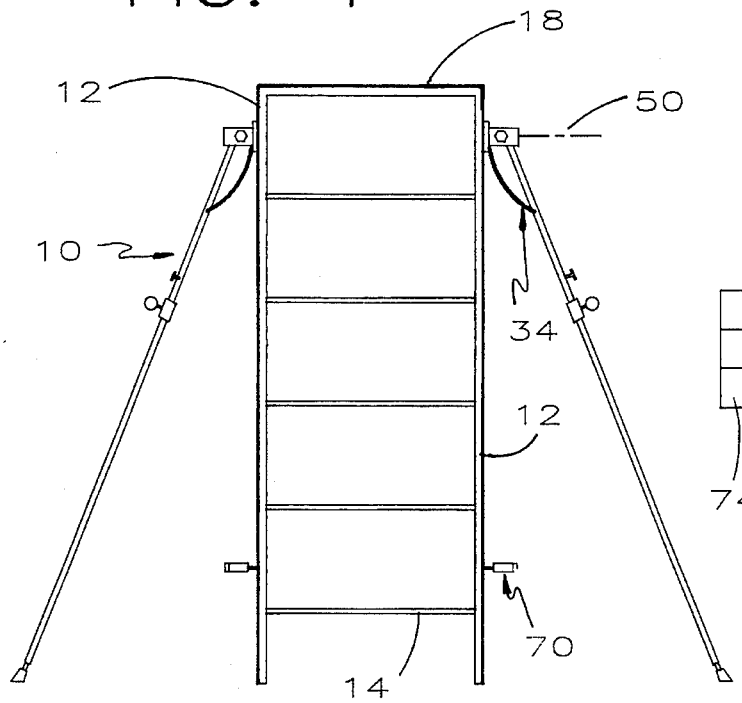
FIG. 1 is a front view of a folding ladder of this invention.
Figure 2:
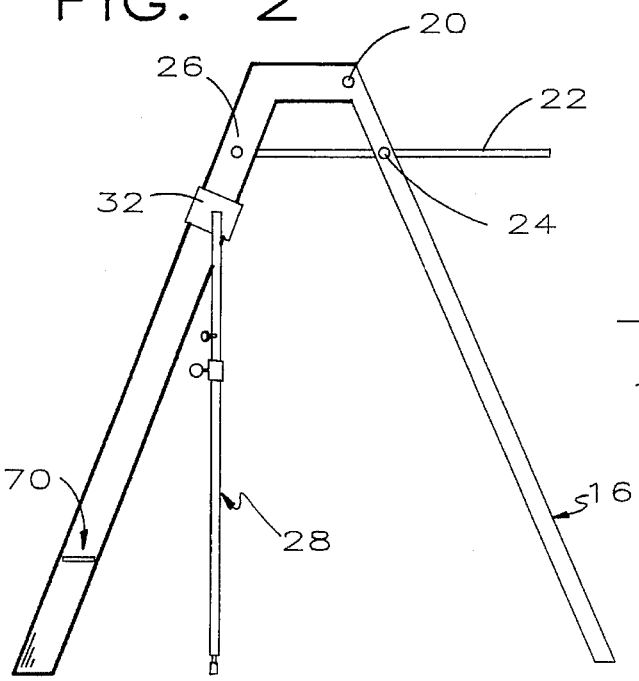
FIG. 2 is a side view of the ladder of FIG. 1.
Figure 6:
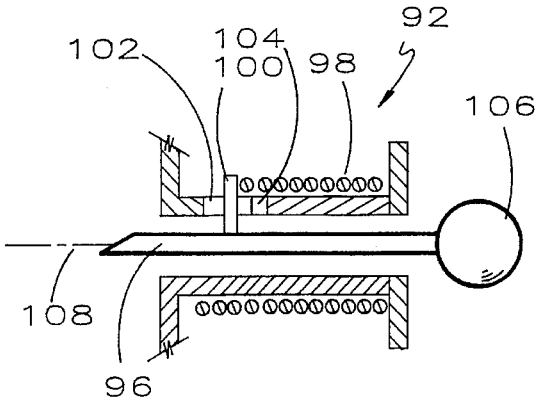
FIG. 6 is an enlarged cross-sectional view of the lug mechanism used in the auxiliary support of FIG. 5.

Referring to FIGS. 1 and 2, a conventional ladder 10 is illustrated as of the folding type and includes a pair of rails or frame members 12 having a series of steps 14 therebetween. A leg assembly 16 is pivoted to a top step 18 by a connection 20. A paint bucket shelf 22 is pivotally connected to the leg assembly 16 and the rails 12 by a pair of connections 24, 26. Those skilled in the art will recognize the ladder 10, as heretofore described, as being typical of modern folding ladders.

Improved lateral stability for the ladder 10 is provided by a pair of auxiliary supports or legs 28. As shown best in FIGS. 2 and 3, the legs 28 are pivotally mounted on the rails 12 by a bracket assembly 30 shown best in FIG. 3. The bracket assembly 30 includes a support plate 32 abutting the ladder rail 12, a spring 34 and a generally U-shaped member 36 connected to the rail 12 by a bolt 38, washer 40, lock washer 42 and nut 44. The bolt 38 includes a threaded. shank 46 and an enlarged smooth section 48. The spring 34 and the bracket 36 are received on the smooth section 48 and are thus pivotally mounted for limited arcuate movement about an axis 50 as shown by the arrow 52 while the threaded shank 46 and the washer 40 rigidly captivate the support 32 to the ladder rail 12.

The U-shaped member 36 provides a pair of side walls 54 having aligned openings therethrough. A fastener assembly 56 includes a second bolt having a ferrule head and a threaded shank, a washer and a nut for pivotally attaching the upper end 58 of the leg 28 to the U-shaped member 36 for arcuate movement about the bolt axis 60.

The spring 34 is of the leaf variety having an upper end 62 captivated between the U-shaped member 36 and the support plate 32. The spring 34 is bent and bowed to provide the desired flexibility and includes a forked lower end 64 receiving and straddling the leg 28 near the upper end thereof. It will accordingly be seen that the leg 28 is spring biased for arcuate movement away from a stowed position adjacent the rail 12 to a supporting position shown in FIG. 1.

Figure 3:
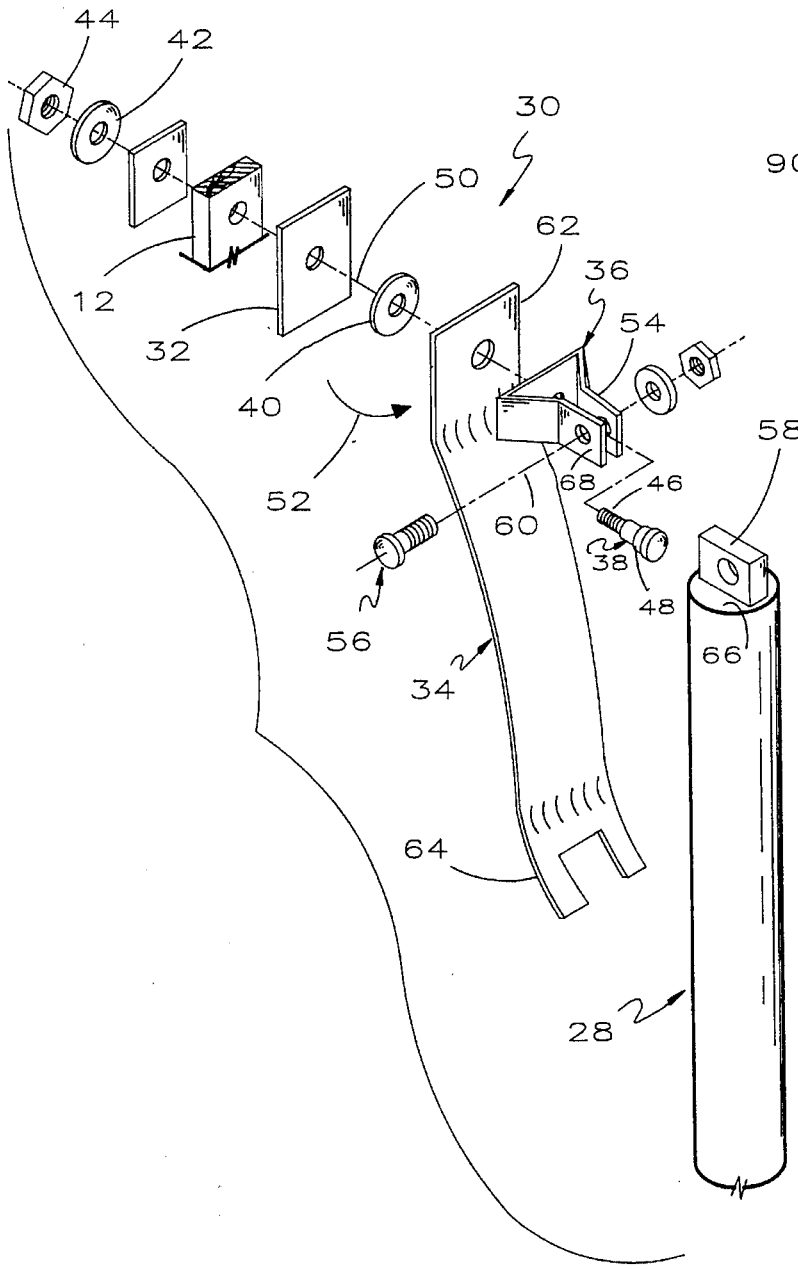
FIG. 3 is an exploded isometric view of the bracket connecting the auxiliary support of this invention to the ladder.
Figure 4:
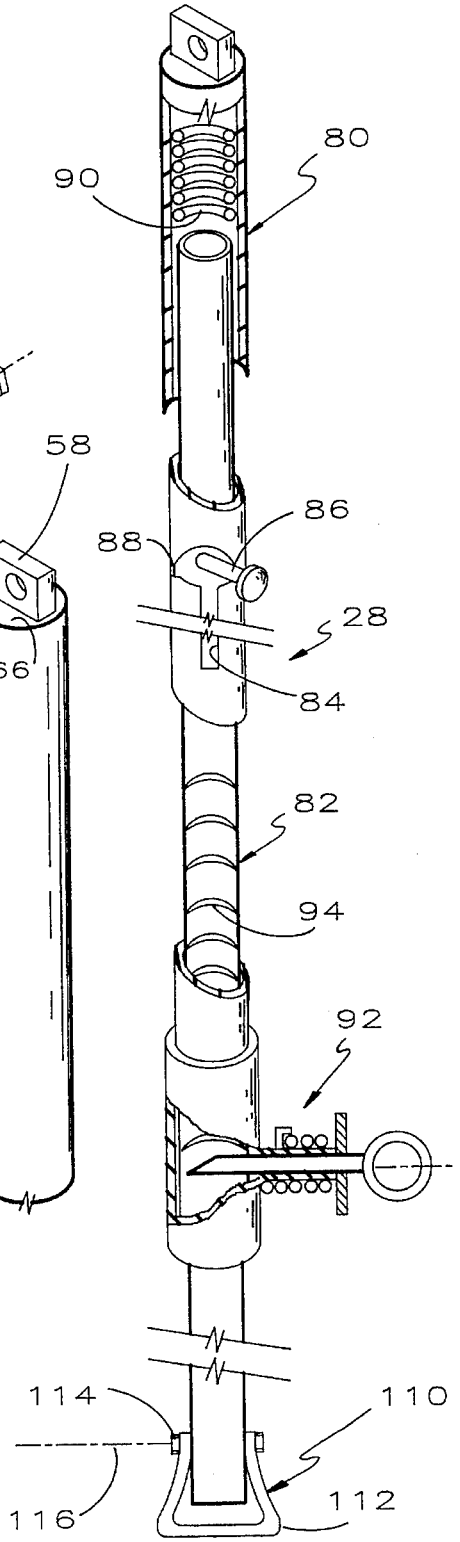
FIG. 4 is a front view of the auxiliary support of this invention, certain parts being broken away for clarity of illustration.

An important feature of the connection shown in FIG. 3 is it limits the outward pivotal movement of the leg 28 to a predetermined acute angle shown in FIG. 1. When the leg 28 is released from the ladder rail 12 as more fully explained hereinafter, the spring 34 biases the leg 28 until a shoulder 66 on the leg 28 abuts the outer edge 68 of the underside of the walls 54. When this occurs, further outward pivotal movement of the leg 28 is prevented.

Figure 5:
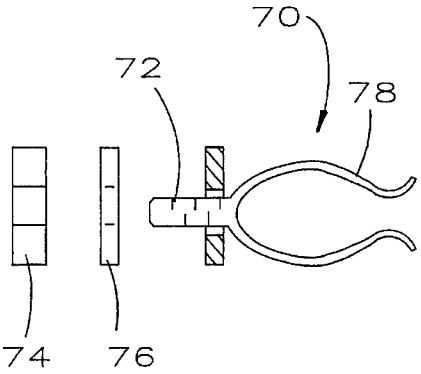
FIG. 5 is a side view of a device to attach the auxiliary support to the ladder in a stowed position.

To retain the rail 12 in the stowed position, a fixture 70 is provided as shown in FIGS. 1 and 5. The fixture 70 comprises a threaded shank 72 which may be connected to the rail 12 by a suitable nut 74 and lock washer 76. A generally U-shaped receiver 78 provides a pair of spring metal arms having an opening there-through slightly less than the O.D. of the leg 28.

As shown in FIG. 3, the legs 28 each comprise an upper or outer tubular member 80 telescopingly receiving a lower or inner tubular member 82. An important feature of the ladder 10 and the leg 28 is that it automatically seeks a position of maximum stability. When the leg 28 is released from its fixture 70, the spring 34 biases the leg 28 outwardly as far as is allowed by the shoulder 66 and wall 54. When released for extending movement, the inner tubular member 82 automatically extends toward the underlying ground surface to find a position of maximum stability. If the ladder 10 later shifts or tilts, the inner member 82 that moves away from the ground automatically extends to a position where it contacts the underlying ground surface and provides stability.

To these ends, the tubular members 80, 82 allow unimpeded sliding movement toward an extended supporting position, provide means for biasing the inner member 82 outwardly toward the extended supporting position, provide means for locking the inner member 82 against retracting movement so it can support a load at the extended position and provide means for manually unlocking the inner member 82 so it can be retracted and moved to its retracted or stowed position.

It will be seen that the inner tubular member 82 slides outwardly relative to the outer member 80 in an unimpeded manner throughout a range allowed by an elongate slot 84 which may be of any desired length but is usually between six inches and one foot long. A handle or pin 86 connects to the inner tubular member 82, extends through the longitudinal slot 84 and controls the maximum amount of movement of the inner member 82 relative to the outer member 80. One or more short J-Slots 88 intersect the long slot 84 for purposes more fully explained hereinafter. A spring 90 biases the inner member 82 in an extending direction as allowed by the slot 84 and handle 86.

The members 80, 82 provide a ratchet or lug mechanism 92 preventing retracting movement of the inner tubular member 82 so the leg 28 can support a load. To this end, the inner tubular member 82 provides a series of spaced teeth or notches 94 and the outer tubular member 80 provides a moveable lug 96 for engaging the teeth 94 and supporting the load. The lug 96 provides a wedge shaped end so the teeth 94, in the direction of extending telescoping movement of the members 80, 82, act to cam the lug 96 radially outward against a spring 98 which normally biases the lug 96 into engagement with the teeth 94. The lug 96 thus provides a projection 100 extending through an elongate slot 102 having a short perpendicular slot 104 communicating therewith. The slots 102,104 accordingly provide a J-slot arrangement. The lug 96 includes a handle or eye 106 for retracting the lug 96 and rotating it about an axis 108 for positioning the projection 100 in the offset slot 104 and thereby positioning the wedge shaped end of the lug 96 out of engagement with the teeth 94. This allows the inner member 82 to retract relative to the outer member 80 so the leg 28 can be stowed.

The bottom of the inner member 82 provides a pivoted foot 110 comprising a U-shaped member 112 and a threaded fastener 114 allowing relative pivotal movement about an axis 116.

It is much preferred to retract the inner member 82 relative to the outer member 80 when stowing the leg 28 in the fixture 70. To this end, the handle 86 is advanced toward the short or J-slot 88 thereby compressing the spring 90. The handle 86 is rotated into the J-slot 88 thereby locking the inner member 82 in a retracted position relative to the outer member 80.

It will accordingly be seen that the members 80, 82 are mounted for unimpeded sliding movement from an axially retracted position to an axially extended position as allowed by the length of the elongate slot 84. The spring 90 pushes the inner member 82 toward the extended position so any time the foot 110 tends to come out of engagement with the underlying ground surface, the spring 90 advances the inner member 82 toward the underlying surface. This moves one of the teeth 94 past the lug 96. When load is again applied to the foot 110, the lug 96 engages one of the teeth 94 and supports the load applied to the leg 28. It will also be seen that the handle 106 and J-slot 102, 104 comprises means manually operable by a user for disabling the lug mechanism 92 by moving the wedge shaped end of the lug 96 out of engagement with the teeth 94. This allows the inner member 82 to move toward its retracted position.

The ladder 10 is normally stowed with the inner member 82 retracted with the handle 86 being in the short slot 88 and the inner member 82 received in the fixture 70. To use the leg 28, the handle 106 is turned so the lug 96 is capable of engaging the teeth 94 in load supporting relation and the handle 86 is turned into alignment with the slot 84. The leg 28 is pushed out of the fixture 70 by the user and the spring 34 swings the leg 28 away from the ladder 10 toward an angled supporting position shown in FIG. 1. The spring 34 biases the leg 28 about the axis 60. If the bracket 36 were rigid with the ladder rail 12, the only movement allowed would be in a plane perpendicular to the ladder rail 12. Instead, the bracket 36 is free to move about the axis 50 as suggested by the arrow 52 so the leg 28 can move rearwardly of the ladder rail 12 as shown in FIG. 2.

Because the spring 90 pushes against the inner member 82, the foot 110 automatically comes into, and stays in, engagement with the ground surface. Because the lug 96 is biased toward load supporting engagement with the teeth 94, the leg 28 is always capable of supporting a lateral load when the ladder 10 tilts. In the event the ground is soft or uneven, the foot 110 remains in load supporting engagement with the ground because the spring 90 and lug mechanism 92 operate at all times when they are in their operating positions.

When it is desired to stow the ladder 10, the handle 106 is turned to disengage the lug 96 and the inner member 82 is retracted into the outer member 80, as by applying weight to the leg 28. When the handle 86 reaches the J-slot 88, the handle 86 is turned to lock the members 80, 82 together. The leg 28 is then pivoted about the axis 60 into the fixture 70.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. A ladder for placement on an underlying support surface comprising first and second longitudinal frame members defining a plane and a plurality of steps extending between the frame members and an auxiliary support comprising a first support member;

means pivotally mounting the first support member on the ladder frame for movement between a first position generally parallel to the ladder and a second position defining an acute angle relative to the first ladder frame member for supporting the ladder against tilting, the pivotal mounting means including a spring biasing the first support member away from the first ladder frame member;

a bracket on the first frame member, a fastener connecting the first support member to the bracket for rotation about an axis and further comprising means limiting movement of the first support member about the axis to a predetermined arc comprising a lug on the first support member for engaging the bracket at the end of the predetermined arc;

a second support member having a ground engaging end and being mounted on the first support member for unimpeded sliding movement from an axially retracted position toward an axially extended position;

means moving the second support member toward the underlying support surface in response to a lack of resistance on the ground engaging end including a spring biasing the second support member toward the axially extended position, means locking, in response to an axial load on the support member, the second support member in a plurality of positions between the extended and retracted positions for preventing movement of the second support member toward the retracted position.

2. A ladder for placement on an underlying support surface comprising first and second longitudinal frame members defining a plane and a plurality of steps extending between the frame members and an auxiliary support comprising a first support member connected to the first frame member and positionable in a support position at an acute angle relative to a first support member connected to the first frame member and positionable in a support position at an acute angle relative to the first frame member for supporting the ladder against tilting;

means pivotally mounting the first support member on the ladder frame for movement between a first position generally parallel to the ladder and a second position defining an acute angle relative to the first ladder frame member for supporting the ladder against tilting, the pivotal mounting means including a spring biasing the first support member away from the first ladder frame member, a bracket on the first frame member, a fastener connecting the first support member to the bracket for rotation about an axis and further comprising means limiting movement of the first support member about the axis to a predetermined arc comprising a lug on the first support member for engaging the bracket at the end of the predetermined arc;

a second support member having a ground engaging end and being mounted on the first support member for unimpeded sliding movement from an axially retracted position toward an axially extended position;

means movable between a first position holding the second support member in the axially retracted position and a second position freeing the second support member for movement toward the axially extended position;

3. The ladder of claim 1 wherein the locking means comprises a plurality of teeth and a lug cooperating between the first and second support members.

4. The ladder of claim 3 wherein the first support member is a tube, the second support member is inside the tube and provides the plurality of teeth and the lug is on the first support member.

5. The ladder of claim 4 wherein the lug comprises a pin having a wedge shaped end for engagement with the teeth mounted for movement toward and away from the teeth and a spring biasing the pin toward the teeth.

6. The ladder of claim 5 wherein the disabling means comprises means for rotating the lug and orienting the wedge shaped end out of engagement with the teeth.

7. The ladder of claim 6 wherein the spring biasing the second support member toward the axially extended position is inside the tube and abuts the second support member.

8. The ladder of claim 2 wherein the first member is a tube and wherein the holding means comprises a J-slot in the tube including a long leg extending axially along the tube and a short leg extending at an angle to the long leg at a location corresponding to the axially retracted position and a pin on the second support member extending through the J-slot.

9. The ladder of claim 3 further comprising means mounting the lug for movement into engagement with the teeth, means movably mounting the lug for movement to a inoperative position out of engagement with the teeth and means for maintaining the lug at the inoperative position, the manually operable means comprising the maintaining means.

10. The ladder of claim 9 wherein the lug comprises a pin having a wedge shaped end for engagement with the teeth, the means movably mounting the lug comprises means mounting the pin for axial movement between an operative lug position for engagement with the teeth and a retracted lug position away from the teeth and a spring biasing the pin toward the teeth, and the maintaining means comprises means holding the lug in the retracted lug position.

* * * * *